US009617705B2

(12) United States Patent
Breedlove et al.

(10) Patent No.: US 9,617,705 B2
(45) Date of Patent: Apr. 11, 2017

(54) RETAINMENT WALL FOR UNDERGROUND MINE AND METHOD OF CONSTRUCTION

(71) Applicants: Sturda, Inc., Azilda Ontario (CA); Heintzmann Corporation, Cedar Bluff, VA (US)

(72) Inventors: John J. Breedlove, Cedar Bluff, VA (US); Erik Denver, Keen Mountain, VA (US); Tyler Proffitt, Pounding Mill, VA (US); Robert Lamond, Azilda Ontario (CA)

(73) Assignees: Sturda, Inc, Azilda Ontario (CA); Heintzmann Corporation, Cedar Bluff, VA (US)

( * ) Notice: Subject to any disclaimer, the term of this patent is extended or adjusted under 35 U.S.C. 154(b) by 28 days.

(21) Appl. No.: 14/710,701

(22) Filed: May 13, 2015

(65) Prior Publication Data

US 2016/0333543 A1 Nov. 17, 2016

Related U.S. Application Data

(60) Provisional application No. 62/001,703, filed on May 22, 2014.

(51) Int. Cl.

| | |
|---|---|
| ***E21F 17/103*** | (2006.01) |
| ***E21F 17/12*** | (2006.01) |
| ***E02D 29/02*** | (2006.01) |
| ***E21D 5/04*** | (2006.01) |
| ***E21D 11/10*** | (2006.01) |

(52) U.S. Cl.

CPC ..... *E02D 29/0275* (2013.01); *E21D 5/04* (2013.01); *E21D 11/102* (2013.01); *E21D 11/107* (2013.01)

(58) Field of Classification Search

CPC ..... E21F 17/103; E21F 17/12

USPC ..... 405/272, 273, 285, 172, 173, 287, 288, 405/302.3

See application file for complete search history.

(56) References Cited

U.S. PATENT DOCUMENTS

| | | | | | |
|---|---|---|---|---|---|
| 3,302,343 | A * | 2/1967 | Bear | E21F 17/103 | 405/132 |
| 4,096,702 | A * | 6/1978 | Burton | E21F 17/12 | 405/132 |
| 5,236,499 | A * | 8/1993 | Chervenak | C04B 28/26 | 106/612 |
| 5,472,297 | A * | 12/1995 | Heselden | E04C 1/395 | 405/258.1 |
| 5,879,231 | A * | 3/1999 | Sisk | E21F 1/14 | 405/132 |
| 5,934,990 | A * | 8/1999 | Steffenino | E21F 17/103 | 454/170 |
| 6,220,785 | B1 * | 4/2001 | Kennedy | E21F 17/103 | 299/12 |
| 6,450,735 | B1 * | 9/2002 | Mills | E21F 17/103 | 405/150.2 |

* cited by examiner

*Primary Examiner* — Tara Mayo-Pinnock

(74) *Attorney, Agent, or Firm* — Carothers and Carothers

(57) ABSTRACT

A retainment wall for underground horizontally extending mine shafts wherein a spaced vertical series of horizontal support ribs are secured to one or more upright supports that are secured in the mine shaft between the side walls thereof. Porous material covers and is secured to the forward retaining face of the wall structure. If the retainment wall structure is to be used as a fill retainment barrier the porous material is spray coated with a settable sealant which covers the forward face of the wall structure and the perimeter thereof to seal off the mine shaft.

15 Claims, 4 Drawing Sheets

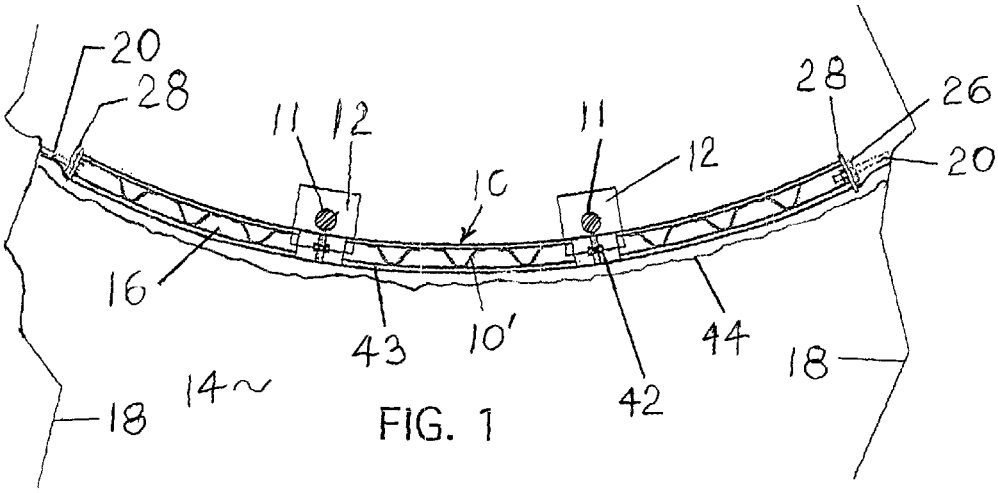
FIG. 1
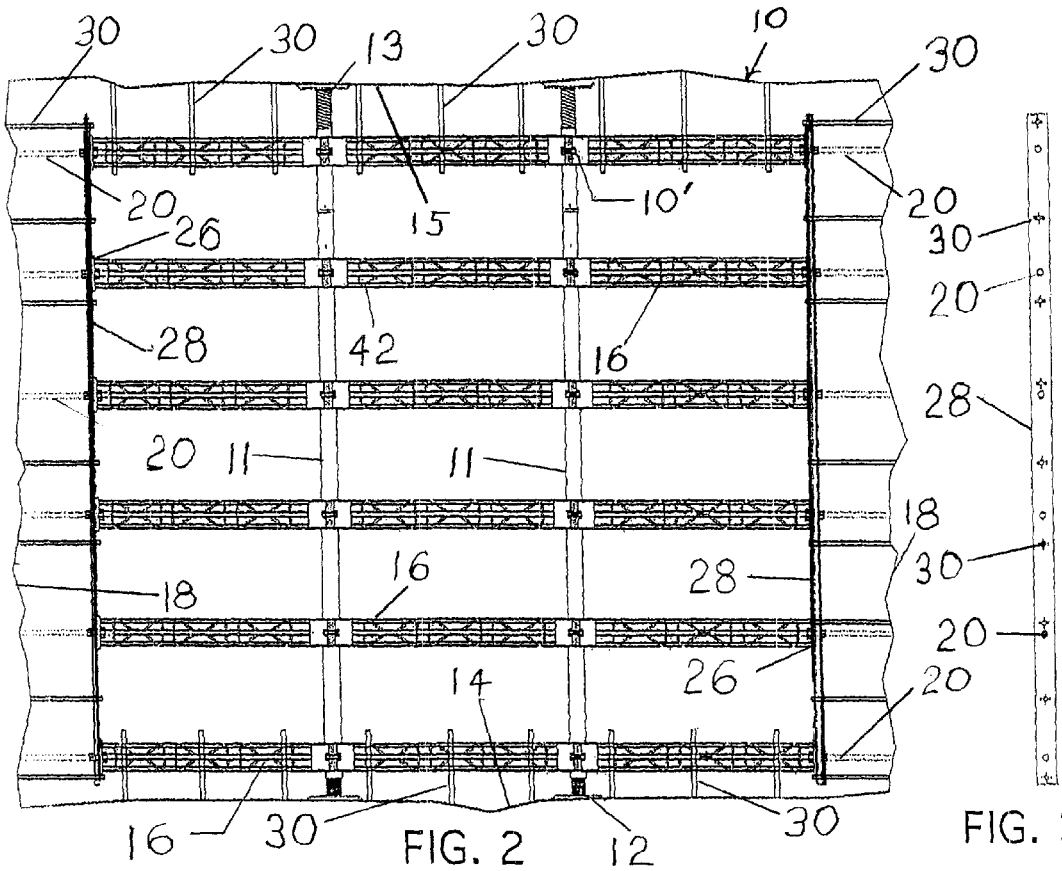
FIG. 2
FIG. 3

RETAINMENT WALL FOR UNDERGROUND MINE AND METHOD OF CONSTRUCTION

CROSS REFERENCE

This application claims the benefit of U.S. Provisional Patent Application No. 62/001,703, filed on May 22, 2014, for GIRDER FENCE, the entire contents of which are incorporated herein by reference.

BACKGROUND OF THE INVENTION

The present invention relates generally to containment of fill material, slurries and slimes in underground mine shafts with a fence structure that is useful in mine construction areas in substitution of present day field containment barriers and weir gates. The present invention is particularly useful due to the ease of installation and the timely manner in which structure can be installed. The design is pre-engineered to meet the local criteria of common fill areas and materials.

In order to reduce mining cycle times, the fill containment fence of the present invention was developed to replace existing methods of fill containment, including shotcrete fences, wooden fences, and cylinder block walls. These fill containment barriers are also used in ventilation stops, underground water sumps, underground slurry containment (such as weir gates), or any other situation where a containment wall might be deemed necessary. As the mining industry is challenged for faster production times, cycle times can be reduced significantly by implementing the fence structure of the present invention. Injury risk is also greatly reduced due to the methods of construction for the fence structure of the present invention.

SUMMARY OF THE INVENTION

The retainment wall of the present invention is intended for application in underground horizontally extending mine shafts, and basically consists of at least one secured upright support positioned between side walls of the mine shaft and a spaced vertical series of horizontal support ribs secured to the at least one upright support for thereby providing a basic wall structure. A porous material covers and is secured to the forward retaining face of the wall structure.

For fill containment applications, the porous material is a spray coat backing material, such as geotextile, and a cured coating of a settable sealant, such as shotcrete or expandable polymeric foam, covers the forward face of the porous material and thereby also seals the perimeter of the wall structure to faces of the mine shaft.

For the fill retainment applications, the at least one upright support is a mine prop or mine props which extend between the floor and the roof of the mine shaft and are secured to the rearward facing face of the wall structure. The one or more mine props may be placed in compressed prestressed engagement between the floor and roof of the mine shaft. In addition, the horizontal support ribs may also be curved convexly in the forward direction in order to increase the retainment capabilities of the wall structure. To further enhance the retainment capabilities of the wall structure, the horizontal support ribs may also be prestressed in compression between the side walls of the mine shaft.

The horizontal support ribs are preferably provided with a stiffening element. The support ribs are typically steel rib members with cross section profiles that provide stiffening. For example, the cross section profile of the support ribs may be in the form of a truss configuration or have a TH channel profile which includes a co-extending channel groove in the rib.

For the retainment wall structure, upright wall plates may be respectively secured to the side wall ends of the horizontal support ribs and then a spaced series of bar segment, such as rebar, is secured to these side plates in order to thereby extend the perimeter of the wall structure to the surrounding side faces of the mine shaft. If necessary, an additional series of spaced bar segments, such as rebar segments, may also be secured to the top and bottom portions of the wall structure to extend the perimeters of wall structure to meet the roof and floor of the mine shaft.

When the retaining wall of the present invention is to be utilized as a weir gate in order to decant mine water from a retained slurry, the at least one upright support is provided in the form of a pair of opposed upright wall supports that are secured respectively to opposite side walls of the mine shaft, and the wall structure is comprised of two segregated side by side wall segments constructed as previously described and which are respectively hinged to opposite wall supports for providing a weir gate which opens in the rearward direction.

The weir wall structure may include a removable center section which is removably secured to and between the hinged wall segments when the weir gate is in a closed position. In addition, it is preferred that a wire mesh cover the porous material and also be secured to the wall structure in order to ensure secure retainment of the porous material or geotextile material.

BRIEF DESCRIPTION OF THE DRAWINGS

Other objects and advantages appear hereinafter in the following description and claims. The accompanying drawings show, for the purpose of exemplification, without limiting the scope of the invention or the appended claims, certain practical embodiments of the present invention wherein:

FIG. 1 is a top view of the retainment wall of the present invention illustrating one embodiment for application of the retainment wall for fill retainment;

FIG. 2 is a front view of the retainment wall shown in FIG. 1 with the porous backing material and shotcrete coating removed in order to reveal the construction detail of the retainment wall;

FIG. 3 is a right side view of the retainment wall shown in FIG. 2 illustrating the side wall support plate with rebar segments extending therefrom in order to extend the side walls of the wall structure to the mine shaft side walls;

DETAILED DESCRIPTION OF THE PREFERRED EMBODIMENTS

Figure 4:
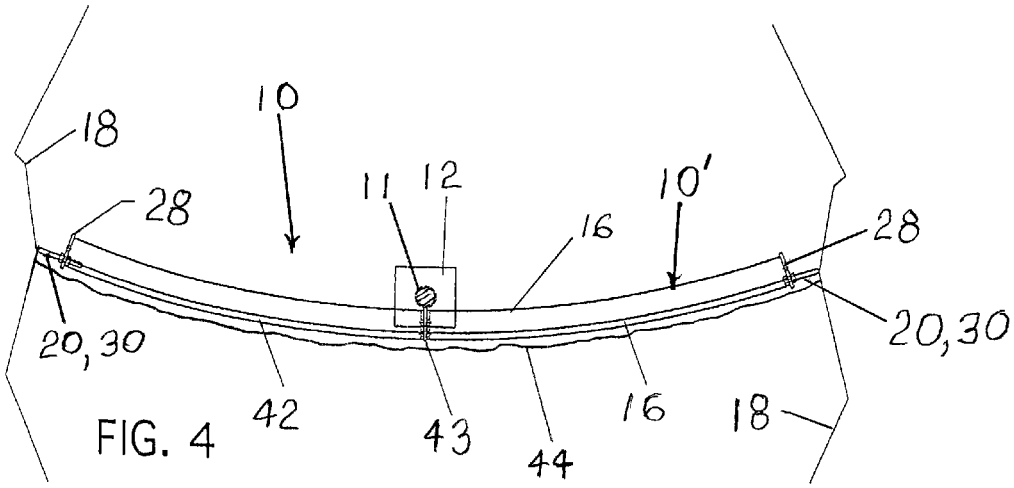
FIG. 4 is a top view illustrating another embodiment of the retainment wall of the present invention intended for application in fill retainment situations.

Referring to FIGS. 1, 2 and 3, the retainment wall 10 of the present invention is constructed in a series of distinct steps wherein the vertical or upright supports 10, provided here in the form of screw jack type mine props, are provided with feet 12 and extendable head plates 13 so that the upright supports 11 may be raised and secured under prestress between the floor 14 and the roof 15 of the mine shaft. The upright supports 11 are spaced appropriately to allow for the installation and support of the horizontal vertical series of support ribs 16.

The floor 14 and the roof 15 are referred to as being part of a mine shaft. However, reference to a mine shaft herein is intended to likewise also refer to a mining drift, stope, opening, or entry, all generally referred to as a mine shaft.

The upright supports 11 support a vertical series of horizontal support ribs 16. Horizontal support ribs 16 are here illustrated as steel structures with a cross section profile that provides stiffening. In this embodiment, the cross section profile of rib 16 is a truss configuration constructed of spaced rebar ribs reinforced therebetween with steel lattice stiffening elements. The horizontal support ribs 16 are secured to the upright supports 11 by conventional bolt and butt plate connections thereby providing a basic wall structure 10'.

In the embodiment disclosed, the horizontal support ribs 16 are curved in the forward direction as illustrated and serve as the primary load bearing members. The horizontal support ribs 16 have upright side wall plates 28 respectively secured to the side wall ends of the horizontal support ribs 16. The horizontal support ribs 16 are also provided with threadably adjustable ends of all-thread rod 20 to accompanying varying widths and to allow for prestressing of the ribs 16 whereby the ribs 16 may be mounted under prestress against the mine side walls 18.

A spaced series of bar segments 30, here steel rebar, are secured to preselected portions (in this embodiment all portions) of the perimeter of the wall structure 10' for thereby extending the perimeter of the wall structure to the surrounding faces 14, 15 and 18 of the mine shaft.

The entire forward face 42 of the extended wall structure 10' is then covered with a porous spray coat backing material 43, such as geotextile, over the entire forward face 42 of the extended basic wall structure 10', and the backing material is secured throughout to the forward face 42 in a conventional manner, such as by wire ties. A sprayable coating of a settable sealant, such as a polymer expandable spray foam or shotcrete (preferably shotcrete 44), is sprayed over the entirety of the backing material 43, and also on and to the connecting faces 14, 15 and 18 of the mine shaft for thereby sealing off the mine shaft. The settable sealant coating 44 is thereafter permitted to cure to thereby complete the retainment wall 10.

Figure 5:
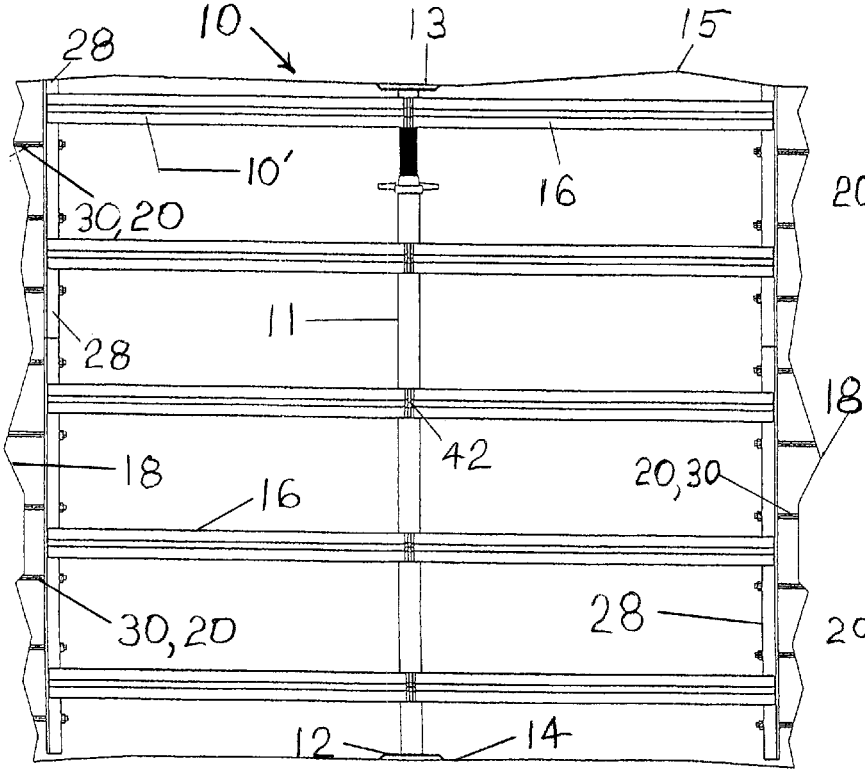
FIG. 5 is a front view of the retainment wall shown in FIG. 4 with the porous backing material and the shotcrete coating removed.
Figure 6:
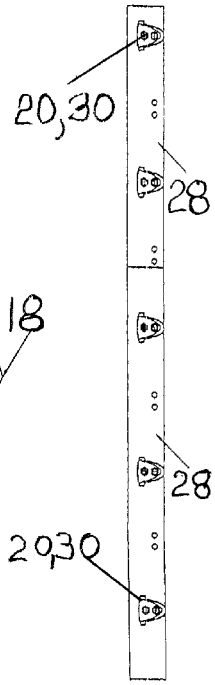
FIG. 6 is a right side view in elevation of the retainment wall shown in FIG. 5.

Referring next to the embodiment of the retaining wall 10 illustrated in FIGS. 4, 5 and 6, the retaining wall 10 here illustrated is in all respects basically identical in construction to the previous embodiment illustrated in FIGS. 1, 2 and 3, with the exception that the vertical series of horizontal support ribs 16 are provided as steel ribs having a TH channel profile which includes a co-extending channel groove in the ribs, this rib structure being more readily available and less expensive to manufacture, yet equally effective, as the truss design of the embodiment shown in FIGS. 1,2 and 3.

A TH-Profile is generally referred to the industry as an elongated steel channel member which has a co-extending center channel with a bottom that merges into thinner side walls which are terminated by outwardly directed flanges. This profile provides the desired stiffening. Also, instead of utilizing conventional bolt and butt plate connections for connecting the rib 16 to the upright supports 11, the ribs 16 in this embodiment are connected to the upright supports 11 by means of conventional TH clamps.

Also, in this embodiment the side wall plates 28 are vertically extended to meet the floor 14 and roof 15 of the mine shaft whereby the extending rebar segments 30 at the top and bottom of the basic fence structure 10' are not required in order to extend the entire perimeter of the wall structure 10' to the mine shaft faces.

Figure 7:
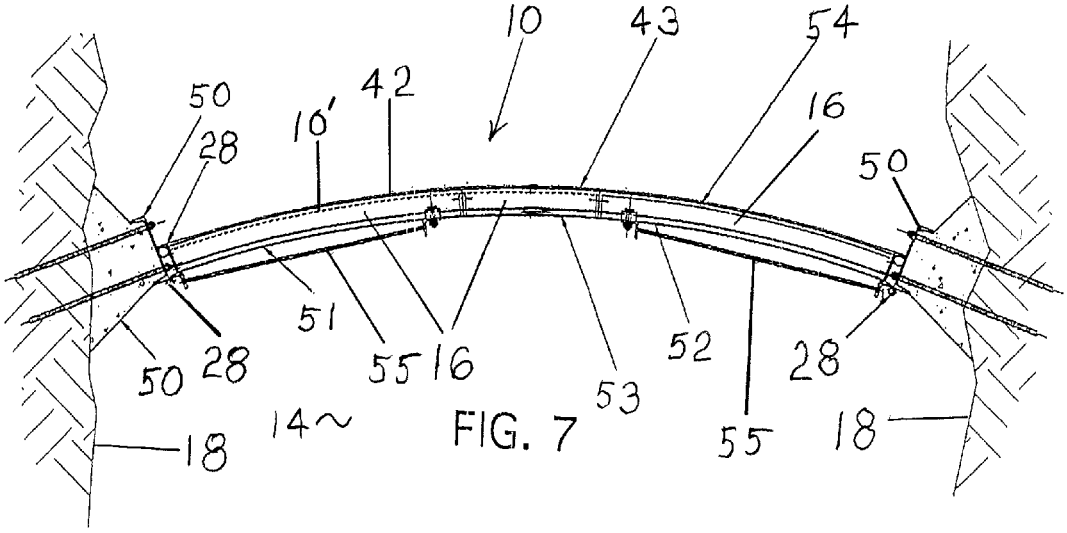
FIG. 7 is a top view showing another embodiment of the retainment wall of the present invention configured for application as a weir gate.
Figure 8:
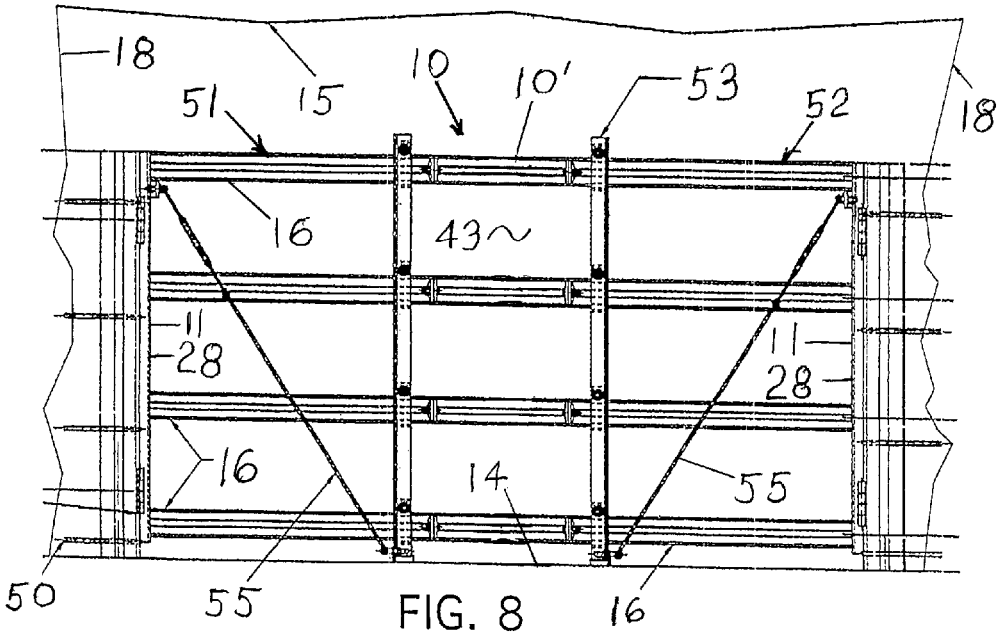
FIG. 8 is a back view of the retainment wall structure shown in FIG. 7.
Figure 9:
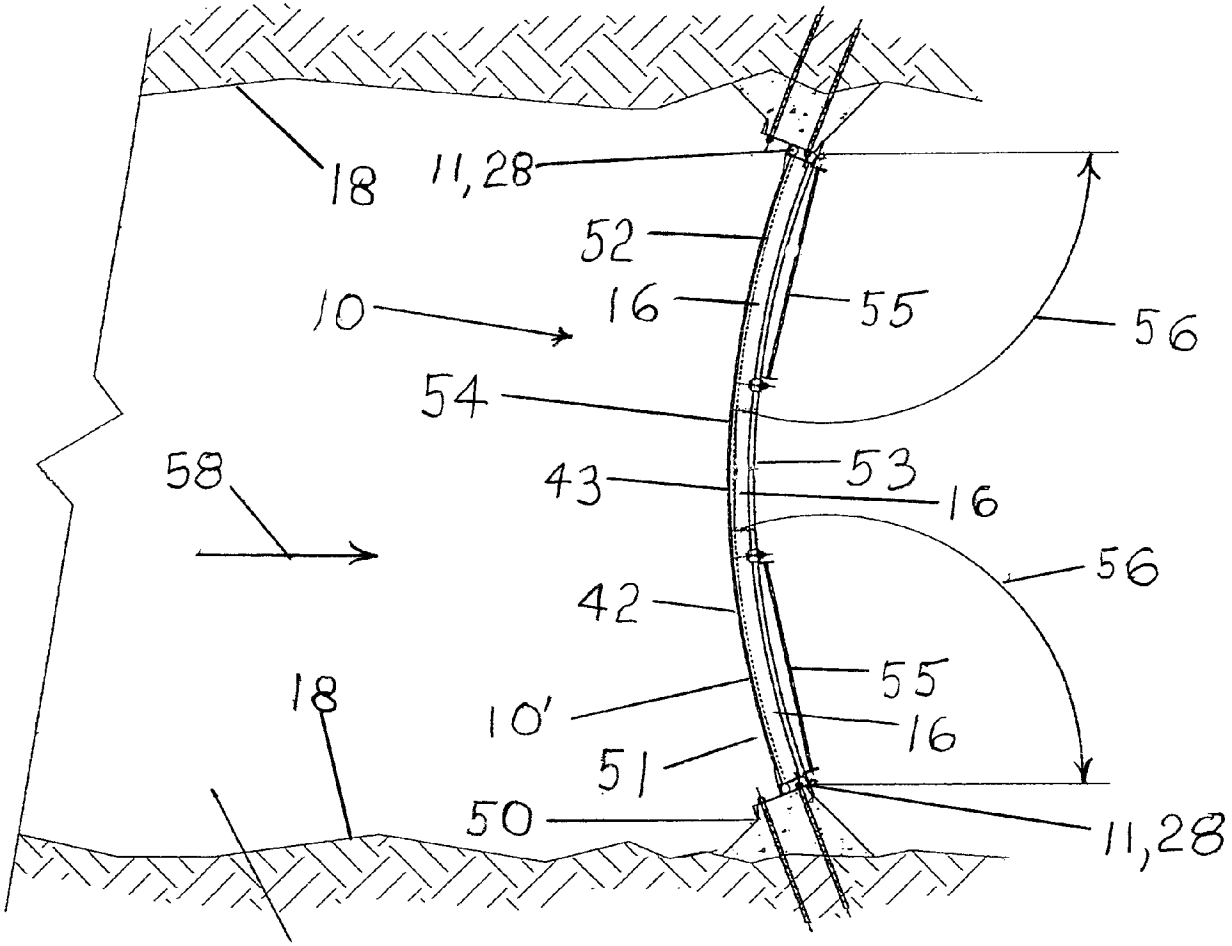
FIG. 9 is a plan view of the retainment wall shown in FIG. 7 illustrating the operation thereof.

Referring next to the embodiment of FIGS. 7, 8 and 9, in this instance the retainment wall 10 of the present invention is illustrated in the form of a weir gate of the same basic construction which serves as a barrier for retention of mine slurry and slimes. The structure of this embodiment permits the discharge water through the filtering of the weir gate to a smaller particle size which can be pumped out to another location in the mine through drain holes in the mine network from level to level.

In this embodiment, the upright supports 11 are provided by a pair of opposed wall supports 11' which engage and seal off the mine ribs or side faces or walls 18 of the mine shaft. These side wall supports 11' are constructed of vertical steel channels 50 which are secured to the side walls 18 by means of all-thread and secured with nuts. The channel 50 is filled with shotcrete and permitted to cure.

Shotcrete as referenced herein for all stated applications is concrete conveyed through a hose and pneumatically projected at high velocity onto a surface as a construction technique. It may be reinforced by steel mesh and reinforced with steel or synthetic fiber. Shotcrete may generally be used as a wet mix or a dry mix. However, for the construction of the retainment wall of the present invention, shotcrete preferably refers to a wet mix. The term gunite is generally used to refer to the dry mix. In applications for the present invention the shotcrete is generally capable of reaching a compressive strength of 20 MPa in 48 hours.

In the embodiment illustrated in FIGS. 7, 8 and 9, the wall structure 10' is comprised of two segregated side by side wall gate segments 51 and 52 which are respectively hinged to the opposed wall supports 50 for providing a weir gate which opens to the rearward direction as illustrated by the arrows 56 in FIG. 9. In this embodiment, the vertical series of horizontally extending ribs 16 are hingedly connected at their side wall plates 28 to the wall supports 50.

The wall structure 10' consists of three segments, namely, gate segments 51 and 52, and the removable center section 53, which is constructed in the same manner and bolted to the side gate segments 51 and 52 when in their closed position.

As with the other embodiments, the forward face 42 of the wall structure 10' is covered with a porous material 43, such as geotextile, which is secured throughout to the respective segments 51, 52 and 53 of the wall structure 10'. This permits water to leach or filter through the porous fabric from the slurry being retained by the forward face 42 of the retainment wall 10.

To further ensure securement of the porous material 43 to the forward face 42 of the retainment wall 10, a wire mesh 54 is applied over the porous material 43 and also secured to the fence structure 10' by conventional means, such as wire ties.

The gate segments 51 and 52 are provided with wire ropes and turn buckle brace combinations 55 in order to reenforce the gate segments 51 and 52.

The floor 14 slopes downwardly toward the retainment wall 10 as indicated by arrow 58 (FIG. 9), whereby mine slurry will flow to retainment wall 10 and accumulate there. Water from the slurry will then filter on through porous material 43 of wall 10 from the accumulated slurry.

We claim:

1. A retainment wall for underground horizontally extending mine shafts, comprising:

at least one secured upright support positioned between side walls of a mine shaft;

a spaced vertical series of horizontal support ribs secured to said at least one upright support for thereby providing a wall structure; and a porous material covering and secured to a forward retaining face of said wall structure;

said at least one upright support is a pair of opposed wall supports secured respectively to side walls of said mine shaft and said wall structure is comprised of two segregated side by side wall segments which are respectively hinged to said opposed wall supports for providing a weir gate which swings open in the rearward direction.

2. The retainment wall of claim 1, wherein said support ribs are curved convexly in the forward direction.

3. The retainment wall of claim 2, wherein said horizontal support ribs are steel rib members with a cross section profile which provides stiffening.

4. The retainment wall of claim 3, wherein said cross section profile of said ribs is a TH channel profile including a co-extending channel groove in said ribs.

5. The retainment wall of claim 3, wherein said cross section profile of said ribs is a truss configuration.

6. The retainment wall of claim 1, wherein said wall structure includes a removable center section which is removably secured to and between said hinged wall segments when in a closed position.

7. The retainment wall of claim 1, including wire mesh covering said porous material and secured to said wall structure.

8. The retainment wall of claim 7, wherein said porous material is geotextile.

9. The method of constructing a retainment wall for underground horizontally extending mine shafts, comprising:

installing at least one upright mine prop extending between the floor and roof of said mine shaft;

attaching a vertical series of horizontal support ribs to said at least one mine prop;

securing upright wall plates respectively to side wall ends of said horizontal support ribs;

securing a spaced series of bar segments to preselected portions of the perimeter of said wall structure for thereby extending the perimeter of the wall structure to the surrounding faces of the mine shaft;

covering and securing a spray coat backing material to a forward face of said extended wall structure;

spraying a coating of a settable sealant over said backing material and the connecting faces of said mine shaft for thereby sealing off said mine shaft; and permitting said sprayed settable sealant coating to cure for thereby providing a retainment wall.

10. The method of claim 9, including prestressing said at least one mine prop in compressed engagement between said mine floor and roof.

11. The method of claim 9, including curving said horizontal support ribs in the forward direction for providing a retaining wall which is convex in the direction of material engagement for retainment.

12. The method of claim 11, including prestressing said support ribs in compression between said wall supports.

13. The method of claim 9, wherein said settable sealant is selected as shotcrete.

14. The method of claim 13, wherein said backer material is selected as a geotextile.

15. The method of claim 9, wherein said support ribs are provided with a cross section profile which provides stiffening.

* * * * *